United States Patent [19]

Kristiansen

[11] Patent Number: 4,595,052

[45] Date of Patent: Jun. 17, 1986

[54] REPERFORABLE BRIDGE PLUG

[75] Inventor: Juan C. Kristiansen, Chubut, Argentina

[73] Assignee: Metalurgica Industrial Mecanica S.A., Buenos Aires, Argentina

[21] Appl. No.: 589,029

[22] Filed: Mar. 13, 1984

[30] Foreign Application Priority Data

Mar. 15, 1983 [AR] Argentina ..... 292396

[51] Int. Cl.[4] ..... E21B 33/129

[52] U.S. Cl. ..... 166/123; 166/135; 166/181; 166/192

[58] Field of Search ..... 166/118, 123, 131, 135, 166/140, 179, 181, 184, 188, 192, 196

[56] References Cited

U.S. PATENT DOCUMENTS

| | | | |
|---|---|---|---|
| 2,928,469 | 3/1960 | Crowe | 166/135 |
| 3,000,443 | 9/1961 | Thompson | 166/192 |
| 3,054,453 | 9/1962 | Bonner | 166/135 |
| 3,100,533 | 8/1963 | Fredd | 166/181 |
| 4,432,418 | 2/1984 | Mayland | 166/135 |

*Primary Examiner*—Stephen J. Novosad
*Assistant Examiner*—William B. Neuder
*Attorney, Agent, or Firm*—Holman & Stern

[57] ABSTRACT

A reperforable bridge plug fastenable to a tool through a weak point and integrated by an elastic gasket between support and compression pieces has a dentated fastener for fastening to a tube line, a bridge plug having a tubular body with upper and lower ends, an enlarged diameter hollow portion on the lower end portion of the bridge plug forming a chamber, a plurality of slots through the wall of the chamber so that it communicates with the exterior of the bridge plug body, a plurality of calibrated rings formed by enlargements of the exterior surface of the wall calibrated to fit the well diameter in which the bridge plug is to be applied, an interchangeable converter plug mounted in the end of the tubular body adjacent the enlarged portion between the chamber and tubular body, a lower compression piece located below the elastic gasket and fastened to the tubular body by a fuse pin and having an external frusto conical surface thereon, a frusto conical surface on the exterior of the enlarged diameter portion spaced below the lower compression piece, and wherein the dentated fastener comprises a cylindrical jaw member mounted on the tubular body between the lower compression piece and the enlarged diameter portion, two oppositely directed diverging frusto conical surfaces on the interior surface of the jaw member at least partially operatively engaging respectively in superposition the frusto conical surfaces on the lower compression piece and enlarged diameter portion, substantially circumferential saw teeth on the exterior surface of the jaw member, and a plurality of circumferentially spaced axially directed slots in the exterior surface of the jaw member to produce weak fracture areas which fracture in response to predetermined relative movement of the lower compression piece and enlarged diameter portion of the bridge plug toward each other.

19 Claims, 32 Drawing Figures

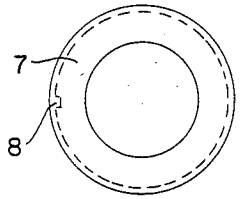
FIG. 12b
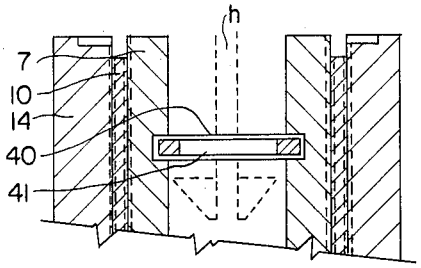
FIG. 15
FIG. 16
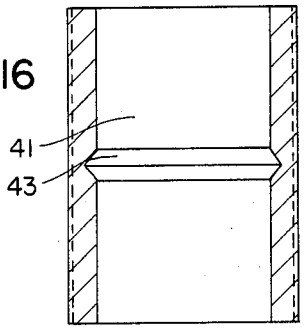
FIG. 12a
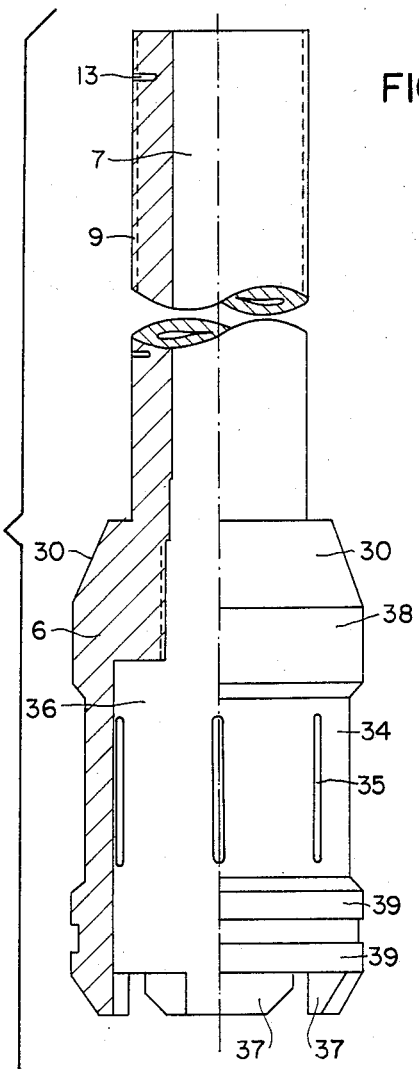
FIG. 17
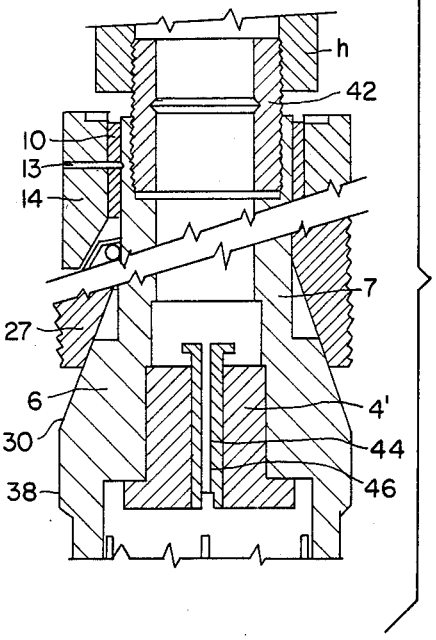

REPERFORABLE BRIDGE PLUG

BACKGROUND OF THE INVENTION

1. Field of the Invention

The present invention relates to a reperforable BRIDGE PLUG of the type used for sealing in transitory or permanent form the perforations lined with pipes or tubes of insulation particularly those that are used in oil wells or the like.

2. Description of the Prior Art

The principal object of the invention is to obtain a new type of plug of the above mentioned type, adapted to be installed in the selected place by any of the proceedings or equipment used in the industry, either with the use of cables or tube lines for such purpose.

The invention has been made to considerably reduce the working and writing time of the costly equipment used in the art, resulting among other bentfits, that shall be enumerated in the course of this specification, in the elimination of the first gate pass prior to the installation of the plug and less time in the milling of the same for its destruction, because with the invention, its rotation has been avoided, through the turn interlock provided. With the above mentioned purpose in mind, the invention also contributes a remarkable constructive simplification that brings about an important economic advantage, and at the same time its technical improvements not only offer a better mechanical fastening, but the possibility of being used in various applications with the same structure, through the change of a single key piece. It is well known that a variety of plugs have been created with the purpose of sealing oil wells, according to the known manner of operating in this activity. Among them is a plug used as support of the sealing elastic body, a gasket composed by one or more deformable plug rings that are accomodated or adhered to the walls of the jacket pipe with the compression set effected by the displaceable pieces proper of the plug, in the inherent process for its placement, so the resilient material or rubber that constitutes the elastic body, does not unduly flow or become exhausted through the plug contour and effect its closing.

In other kinds of plugs, these annular bodies have been substituted, through both simple or double laminar washers, with a skirt of frusto-conical shape directed toward a conformation similar to the elastic body in agreement with the washers.

In other cases the sealing element is materialized by resorting to two or three independent elastic bodies, with peripheral lips and forms as displaceable blades, that complement each other with the purpose of improving the closure.

Other small differences existing among the known models could be mentioned. Notwithstanding, it is advisable to understand that the whole of these appliances resort to the use of two jaws arranged with the other component pieces at each side of the packers elastic body or bodies.

As known by the expert on the subject, these jaws, at the end of the process of placement of the plug, that is to say, once the expansion of the elastic packer body is obtained and the respective fuse pins are broken and before the weak tension point is broken, the above mentioned jaws, are expanded, nailing their teeth on the tube line of jacket pipe to secure the immovability of the plug in its position. In the already mentioned conventional plugs provided with two jaws, it has been proven that in the process of the plug fastening it is required that the indented jaws are approached between each other in order to provoke the deformation of the flexible gasket. Breaking the first fuse pin displaces the upper cone and the respective jaw, while the lower one remains fixed, so that relative displacement causes a strong rubbing of the teeth of the jaws against the steel tube wall which, taking into consideration the important forces in operation, the teeth suffer a strong abrasion making them blunt and subsequently restricting their capacity of penetration in the wall and therefore weakening the mechanical fastening of the plug. In some cases, both jaws are displaced impairing the situation.

Another constructive aspect of this pair of jaws may be mentioned, in certain cases they are constituted by independent segments fastened by "fuse" screws to the respective cone or maintained in position by rings mounted in a perimetral throat or by a wire of copper winding.

In another embodiment, the jaws are substantially cylindrical bodies with channels arranged according to interior generatrix which defines areas of lower resistance, but offer the problem of the formation of burrs in the fracture areas directed toward the periferic contour and moveover to the loosening of fragments the presence of which between the teeth of the jaws cause subsequent disturbances.

Other usual problems in the perforations under consideration are included in the rubbish found inside the tubes. In order to eliminate this, the use of baskets must be resorted to, incorporated with the gages for their recuperation, by passing this device through the tube line, so that all the matter that is found in its downward direction is collected in its interior basket. In the hitherto known techniques, the use of the gage is essential, in as much as with them there are found variations in the diameter of the jacket pipe. Variations may be originated, for example, in the perforated layers, that a mentioned above offer holes with burrs which may create problems in the downward direction of the plug. With the gage, collapses and/or failures are also detected which are due to an excessive thread of the pipe section, which also causes burrs in the edges of the pipe and even its flare shape. There are known the anomalies which may be found in the tube line covering the wells, that can be detected by the different systems used by the surface installations for placement of plugs.

It is obvious that taking into consideration the high cost of the equipment placed on the well, the less intervention time of each one on each perforation may result in a lower cost per cubic meter of the oil obtained. For such purpose it is very important to attain the maximum guaranty that the tube line with which the perforation has been lined be in perfect condition. That is to say, that since a slight diameter difference exists between the plug and the tube, the plug may be lowered without trouble and there are no undesirable burrs, collapses or rubbish which may affect its downward movement. Consequently, it is required to lower in the first place a calibrator device which carries downwardly all the rubbish which is being housed in its interior part. This kind of basket is exteriorly shaped, with annular calibrated bands the diameter of which will guarantee that the minimum diameter found in the well, shall not affect the lowering of the plug.

So in each perforation and in a manner prior to the placement of each plug, it is necessary to effect a stroke with the above mentioned calibrated basket. As briefly mentioned in the foregoing paragraph, the plugs may be fastened through arrangements operated by cable or pipe, in the first case the fastening system operated by remote control depends from a cable and in the other it is obtained through rotation of the tube line with which the plug is seated and fastened on the selected place.

In the cable plugs several problems may arise, such as when blasting charges are used, their deflagration produces gases generated in a closed chamber that are transformed into hydraulic pressure which at the same time causes a mechanical force. It may occur that the well fluid may penetrate inside the appliance thus avoiding its correct operation.

With the plug under consideration, as only the rubber has been swelled, it may be once more recuperated, which is not common with a conventinal plug because the latter has to be mechanically fastened and afterwards must be rotated and reinitiate the cycle, which is very costly.

BRIEF SUMMARY OF THE INVENTION

In order to overcome the above problems, the object of the invention is ideal, in as much as with its new constructive arrangement, the first necessary pass of the caliper is eliminated, because the plug itself already constitutes a substantial modification of the relevant technical-economical importance, as it reduces the time of use of the surface equipment and a subsequent cost reduction. Simultaneously, the tube line calibration is obtained guaranteeing that the diameters are not inferior to those established. Also, the rubbish and debris that may exist within the conduit are collected.

As regards the mechanical aspect of the new reperforable bridge plug of the invention, the plug has been developed with great simplicity, incorporating everything necessary for its optimum operation avoiding the eventual failures and eliminating various parts whose sole presence introduce higher probabilities of originating undesirable failures. In a manner that in more detail will be oblserved hereinafter, a simplification has been reached by designing the new plug with a single interior jaw instead of two jaws as in all the known plugs, to which are added the complementary pieces which have been also eliminated in the invention. Another improvement obtained with the new plug, resides in the improved shape of the support ring of the elastic gasket forming part of the plug, which at the same time is constituted by a sole piece with incorporated interior seal.

Another advantage provided by the plug of the invention, in compliance with the new idea of its constructive arrangement consists in that it admits a range of utilization impossible to attain with any of the known devices. Therefore, all the basic structure of the body and its accessories to harmonize the operation of the plug are the same. The key piece that permits the transformations in a simple and economic manner is a piece which shall be precisely called converter plug.

Consequently, the alternative uses may be enumerated in the following manner:

I—Cementer bridge plug

II—Production bridge plug

III—Articulated joint bridge plug in which a check valve is included which may be opened through a controlled tube IV—Bridge plug to inject, provided with interchangeable calibrated hole V—Bull bridge plug VI—Sloveliness bull plug of reduced cost.

In the preferred embodiment that shall be described in detail hereinafter, the reperforable bridge plug of the invention is comprised of an interchangeable converter plug piece mounted on the end of the tubular body of th bridge plug, in correspondence with a widening shaped in said body which forms a chamber in the base, the chamber walls are crossed by a plurality of grooves for communication with the exterior of the bridge plug body; the widened exterior surface of the body presents calibrated rings to the daimeter of the well to which the bridge plug is applied; said dentated means of mechanical fastening of the bridge plug to the tube line are arranged on one single jaw. Interiorly arranged subseqeuntly to the elastic gasket and of its support and compression pieces, the jaw of which is mounted on the tubular body of the bridge plug presents two opposed frusto conical areas interiorly arranged and diverged so they are operatively connected through contact and partial superposition so the superior area related with the conical compression piece fastened to the tubular body through one fuse pin and the interpolation of a turn lock while the inferior area is connected with the frusto conical contour shaped in the outer surface adjacent to the above mentioned widened body of the bridge plug, the outer surface dentated in the saw tooth of the jaw, is arranged so the points of said teeth are placed in opposed directions as from one medium diematrical line and presenting a plurality of symmetrically distributed cuts according to both generatrix.

BRIEF DESCRIPTION OF THE DRAWINGS

In order that the invention may be easily understood and may be put in practice without inconveniences, detailed description of a preferred form of embodiment will be hereinafter explained, with reference to the accompanying drawings, all of which are a purely illustrative example of the invention but not a restrictive example and wherein:

FIGS. 12*a* and 12*b* are elevational and end views, respectively, of the bridge plug body partially in cross-section;

FIG. 15 is a cross-sectional view of an embodiment including a ring that shall work at cut as "weak point";

FIG. 16 is a cross-sectional view of another embodiment variable of the "weak point", consisting in the case in a thread coupling; and FIG. 17 is a cross-sectional view of another embodiment of the converter plug as a calibrated element.

DETAILED DESCRIPTION

Figure 1:
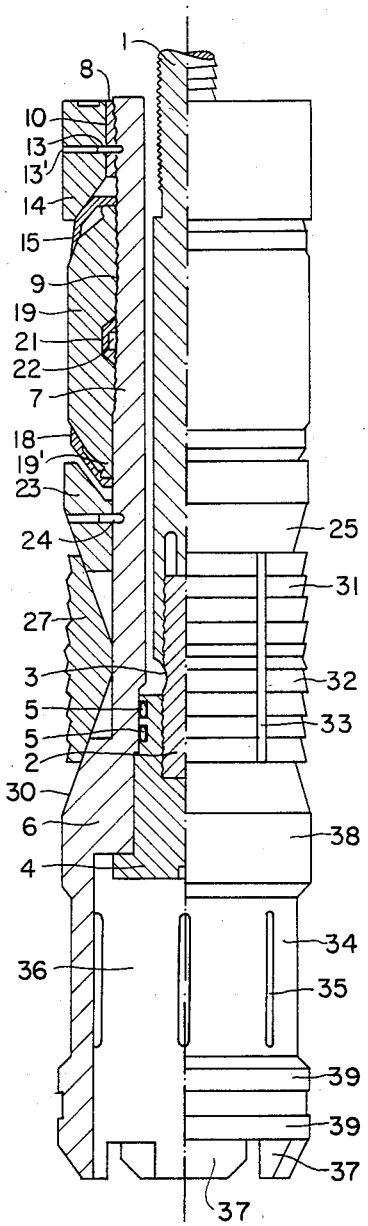
FIG. 1 is an elevational view, partly in cross sectin, showing the reperforable bridge plug of the invention.
Figure 3C:
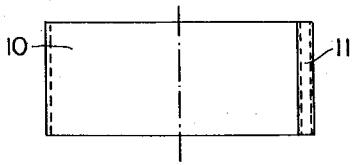
FIGS. 3*a*, 3*b*, 3*c* show in its three positions the fastener ring.
Figure 3D:
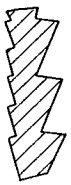
FIG. 3*d* shows a detail in enlarged cross section of the right side of FIG. 3*c;*
Figure 3B:
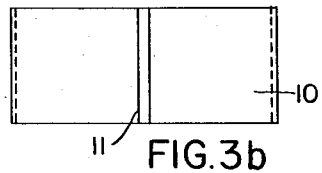
Figure 3A:
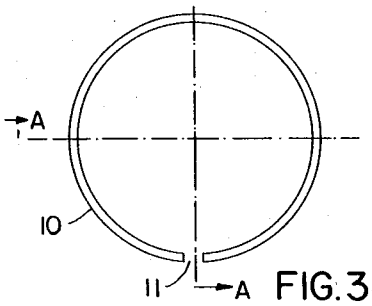

In the figures the same reference characters indicate similar or corresponding parts.

In FIG. 1 the reperforable bridge plug of the invention is constituted by the tension mandrel 1 of the connection between the tool (not shown) and the plug that is constituted by a bar threaded in an end connectable to the tool and an interiorly threaded housing in its opposed end, where the weak point is fixed which consists in this case in a stud bolt 2, with a reduced throat 3 cross-section in its central area that provides a fracture area and through which the mandrel 1 is connected to the converter plug 4, in the annular seal ring grooves 5 of which both sealing toric rings are arranged.

Figure 2A:
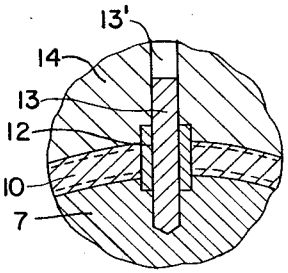
FIG. 2*a* is an enlarged cross-sectional view showing a detail of part of FIG. 2.
Figure 2:
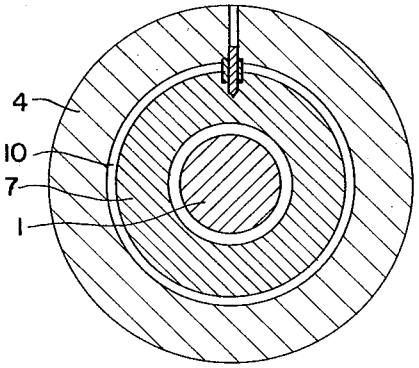
FIG. 2 is a cross sectional view of the turn lock device.
Figure 6B:
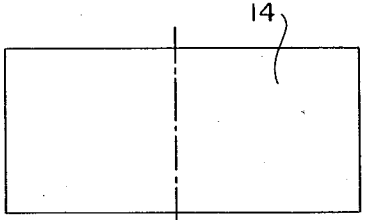
FIGS. 6*a* and 6*b* are views in two positions and FIG. 6*c* is a cross sectional view of the superior cone forming part of the plug.
Figure 6C:
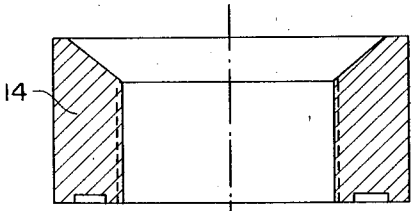
Figure 6A:
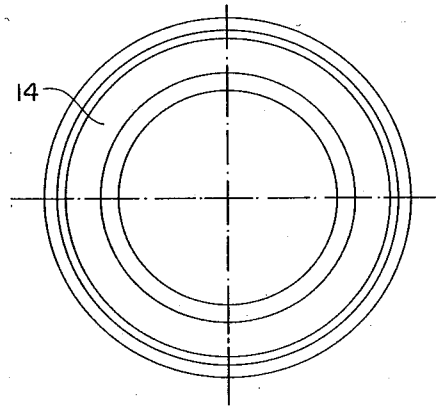
Figure 13:
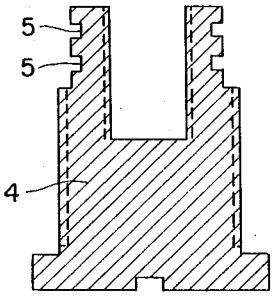
FIGS. 13*a* and 13*b* are cross-sectional and bottom plan views, respectively, of the converter plug.
Figure 13B:
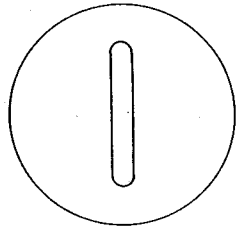
Figure 14:
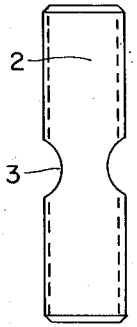
FIG. 14 is an elevational view of the piece known as weak point.

The converter plug 4 (also see FIG. 13*a*), is threaded in the body 6 of the plug. The upper section of body 6 has a tubular cylindrical form 7 and a keyway 8 and is saw tooth threaded with the points downwardly in its outer surface 9 along a certain length. On this thread the fastener ring 10, illustrated in detail in FIGS. 2 and 3, is threadedly mounted the inner thread of which, also a saw tooth with opposed inclination, has a pitch double that of the outer thread. Exteriorly ring 10 is threaded in a saw tooth form similar to that on the body 6, but with the points directed upwardly.

Figure 4A:
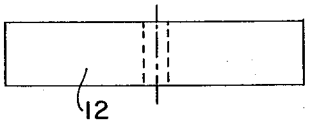
FIGS. 4*a*, 4*b* show the turn lock in two positions.
Figure 4B:
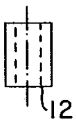
Figure 5A:
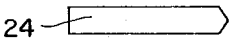
FIGS. 5*a*, 5*b* show the superior and inferior fuse pins.
Figure 5B:
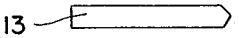

The fastener ring 10 is cut through to provide a space or slot 11 between its free ends, which in the assembly corresponds with the keyway 8 of the tubular protion 7 of the body 6, for the purpose of housing the turn key 12 illustrated in detail in FIGS. 4*a* and 4*b*. This is first mounted in the assembly and fastens it into position, and is fastened through the upper fuse pin 13, passing through the upper cone 14 and partially housed in the hole 13' that penetrates into the body 6, 7.

Figure 7B:
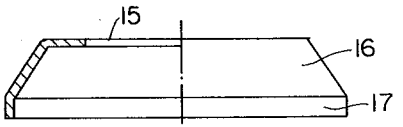
FIGS. 7*a* and 7*b* are views in two positions with a partial cross-section of the support ring.
Figure 7A:
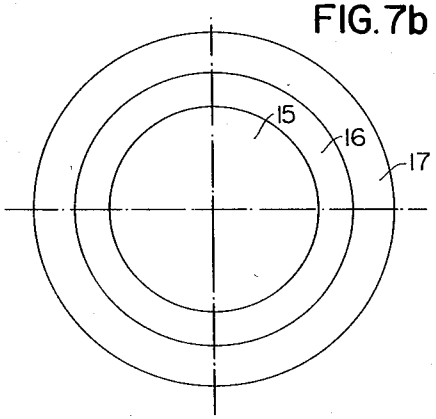
Figure 8:
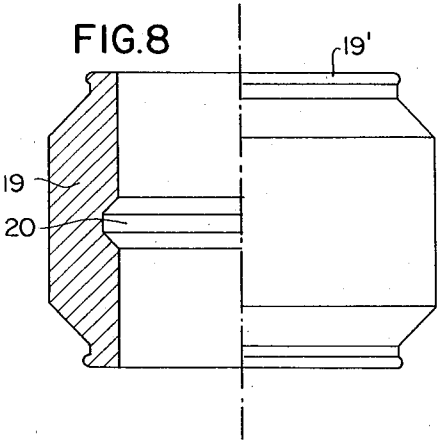
FIG. 8 is an elevational view in partial cross-section of the elastic gasket.
Figure 9:
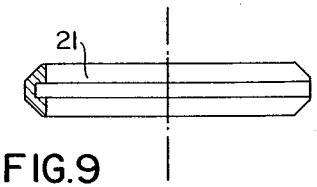
FIG. 9 is an elevational view partially in cross-section of the interior seal arranged within the elastic gasket.

The upper cone 14 has machined thereon an annular flat bottom on its outer face and has an inner saw thread tooth in order to admit the fastener ring 10. Beneath the above mentioned cone 14, a support ring 15 is arranged which is constituted by a laminar body with a form similar to a cup, (see FIGS. 7*a* and 7*b*), comprising a central annular flat part with the corresponding central hole, and a frusto conical outer section 16 ending with a cylindrical flange of relatively reduced height 17. This support ring 15, jointly with a similar one 18 arranged in inverted position, embodies between both the elastic gasket 19. This gasket as shown in FIG. 8 bears shaped in its inner part a channel 20 of trapezoidal transversal section, within which a metal ring 21 of similar shape is housed, and within which is arranged a toric seal 22.

Both ends of the body 19 are cylindrical presenting extensions of a relatively reduced diameter, with peripheral ribs 19' in the respective ends. This shape predisposes the deformation of each support ring 15 and 18 to carry same to the more convenient position.

Figure 10C:
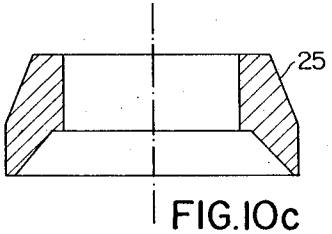
FIGS. 10*a*, 10*b*, 10*c* are views in three positions showing the interior cone, in elevation, plan and in cross-section.
Figure 10B:
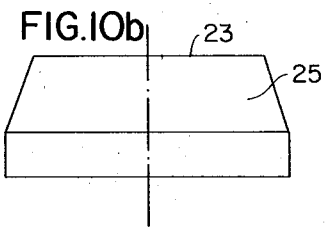
Figure 10A:
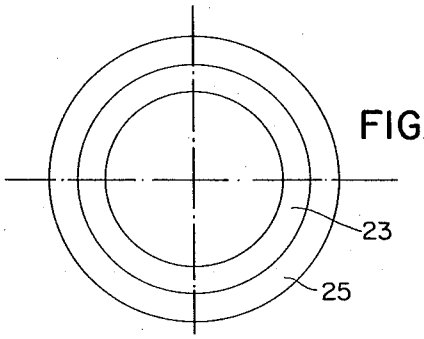

Supported below the support ring 18, the lower end 23 is arranged, the characteristics of which may be easily observed in FIG. 10. This cone is fixed to the body 6, 7, through the lower fuse pin 24. It is observed that the lower zone also has part of its exterior surface in frusto conical shape 25, to relate same through contact with the also frusto conical interior surface 26 of the jaw 27. The above mentioned interior surface of the jaw 27 is completed with a cylindrical central area, of similar diameter, with a slight adjustment, as the cylindrical portion 7, of the body 6, following with another frusto conical area 29 adaptable to the frusto conical exterior 30 of the body 6.

Figure 11C:
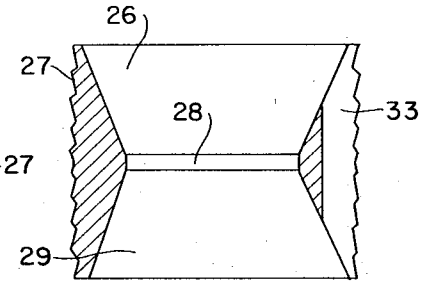
FIGS. 11*a*, 11*b* and 11*c* are plan, elevation and cross-sectional views, respectively of the jaw in accordance with the principles of the invention.
Figure 11B:
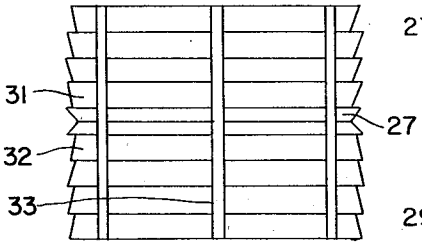
Figure 11A:
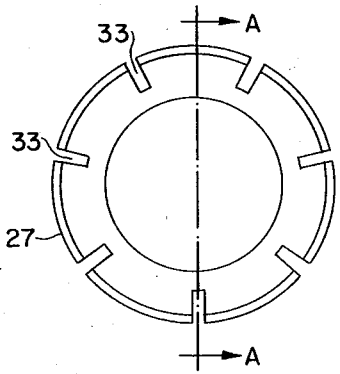

The FIGS. 11*a*, 11*b* and 1*c*, where the jaw is shown in better detail, in addition to showing the above mentioned details, show the dentated exterior surface of saw tooth type, where the inclination of its teeth, changes from a central diameter in opposed directions upwardly in the upper one 31 and downwardly the lower one 32. This jaw, which as observed in the assembly FIG. 1 is arranged in the lower part of the plug, is provided with a plurality of cuts 33 symetrically distributed, acording to the generatrix of the piece, causing fracturable weak areas. When in operation the rupture conditions are produced, the jaw is frgmented in equal segments. According to private tests effected in due course, it was considered as optimum the quantity of seven cuts which are machined in order to obtain a minimum thickness of the cuts and still not lose a contact surface. With the seven segments produced, it is possible to obtain a better gripping against the jacket pipe.

The lower part 34 of the body 6, presents a hollow widened section with a plurality of vertical slots 35 which communicate the outer part of the plug with the interior part of the body, whereby a chamber forming member of basket 36 is defined, restricted in the upper part by the converter plug 4.

This chamber forming member 36 has the dentated end 37, the teeth of which have been especially designed in order to attain a better locking effect and to permit the plug to be anchored in such a manner, either in the bottom of the well or else on another plug, in order to rotate same in lesser time. The body 6 is completed with the diameter at 38, being calibrated to the diameter of the jacket pipe,complemented with another two rings of equal diameter 39, arranged near each other, but separated by a small space.

In general, all the pieces forming parts of the plug are manufactured with white cast iron which is more easily destroyed by the mill when it has to be withdrawn from its position.

In order to effect the conversions allowed by the converter plug 4, the channel 40 may be incorporated in the body 6, 7 of the bridge plug, as illustrated in FIG. 15 where the ring 41 is housed, which shall work at cut and shall act as a "weak point" with the cooperation of a suitable tool h. Moreover, in other applications, a tool h may be fixed to the modified bridge plug modified through a nipple or threaded coupling 42, illustrated in FIG. 16, which shall operate as a weak point at the notch 43 therein.

The object of these modifications, is to avoid any obstacle along the whole interior part of the plug body, allowing a free access to the place into which is placed the above mentioned fitting.

As shown in the above specification, the complete arrangement described is addressed to the obtainment of bull bridge plugs and of slovenliness bull plugs, where in the latter, lower cost materials are used in order to cheapen the product. The replacement of the converter plug 4 and the incorporation of the cut ring 41, or the nipple 42, permit access to the central tube of the plug body in order to facilitate adding the corresponding fixture so that any of the above-mentioned operations may be effected, being only possible with the invention arrangement and introducing the adequate type of valve in the piece 4 or in replacement of same. The incorporation of the calibrated hole 44 in the converter plug 4 and the replacement of the weak point 2, 3 with the threaded coupling 42 according to that illustrated in FIG. 17 permits disposing of the required plug to be applied as a dosifier in the injector wells. It is known that in injector wells, secondary recuperation wells, the water injected water flow, as well as the used pressure are of extreme importance in order to avoid problems which may render useless the area. For such reason, the water should be correctly dosified in order to channel a determined flow with a good determined pressure and push the oil toward another well.

Normally, small seal balls are provided in the ground water in order to seal the holes of the punching and restrict the conduction of the water flow.

The problem of difficult handling is solved through the converter plug. Interchangeable steel tube 46 having a linear hole 44 therethrough is provided in the plug 4' in order to obtain the necessary flow. Therefore, the regulation of the flow corresponding to the selected size of the hole 44 may be effected in an interchangeable way according to the needs. The steel lining for the hole is to prevent wear and obtain a longer life of the device.

In a certain construction interchangeable calibrated tubes 44 may be changed by surface equipment in order to permit the flow modifications which may be necessary at the time. The functional relation is simple and it is carried out in the following manner:

Once a certain well is drilled and the coats placed in their respective levels the need may arise for placing one or more plugs as the case may be. The placement technique in any of the cases is fulfilled according to an automatic sequence of passes which are connected according to the gradual increment of the compression, after a shooting signal originated from the surface equipment which provokes the deflagration of the charge provided for said purpose, and initiating the tool motion. Consequently, in the first place, the bridge plug is carried to the exact level where it is to be placed, and afterwards said charge is shot and the pressure increase is initiated in order to cut the first fuse pin 13. With that causing the relative displacement of the upper cone 14 with respect to the body 6, 7 which stays fixed supported by the tension mandrel 1, a pre-pressure is induced on the gasket 15 that swells the gasket until making contact with the well lining. At the same time the deformation of the elastic body of the gasket deforms the fastener rings 15 and 18 the flanges 17 of which also touch the well lining strongly resting against it, which influences deformation of the rubber which constitutes the gasket and maintains an angular inclination which prevents the elastic material from flowing through the space existing between the well lining and the plug body and confines it in the thus established space.

When the pressure is increased to a value capable of cutting the second fuse pin 24, a pre-pressure on the jaw 27 is initiated through the lower cone 23 which is freed and slides on the body 7 of the plug. As the bridge plug body widens toward its base in the area 6 and there another conic surface 30 is shaped, when the pressure has reached the pre-established value, the jaw 27 breaks along the lines of lesser resistance produced by the cuts 33 being separated in segments, the teeth of which 31 and 32 penetrate into the well lining fastening more each time and so producing the maximum deformation of the gasket 19. It may be recalled that the body has been steady by the traction to which it is submitted by the action of the tension mandrel 1 in correspondence with the tool (not illustrated), while the exterior parts of the plug advance as described, neutralizing the mandrel tension efforts and the peripheral compression, with the movement of the parts forming part of the plug.

It is especially noted that during all this process, the jaw 27 has stayed motionless, therefore its dentated surface has stayed completely intact to be nailed with all firmness to the steel tube wall. The turn lock, composed by the fastener ring 10, the tie or lock 12 and the fuse pin 13, at the same time operates as a union device, is shaped so that its function results precisely to avoid rotary displacement of the upper cone 14 with respect to the bridge plug body 6, 7. When the fuse pin 13 breaks, the special dentated system of simple and double pass saw tooth existent between the body 7 and the exterior and interior part of the washer 10 and the conic body 14, permits the axial displacement of the assembly 10, 14 during the compression effect imposed by the tool action throughout the channel 8 always keeping the lock against the relative turn of the so connected component parts. This process reaches its conclusion when the pressure reaches the value which causes the rupture of the weak point 2, 3.

At this time, the tool is free to be raised and the bridge plug placed and well fixed in its position.

It is logical to suppose that in carrying this invention into practice, amendments may be introduced without departing from the fundamental principles specified in the accompanying claims.

I claim:

1. In a reperforable bridge plug of the type having means for fastening to a tool through a weak point and integrated by an elastic gasket between support and compression pieces, and dentated fastening means for fastening to a tube line, the improvement comprising:

a bridge plug having a tubular body with upper and lower ends;

an enlarged diameter hollow portion on the lower end portion of said bridge plug forming a chamber having a tubular wall in said lower end;

a plurality of slots through said wall so that said chamber communicates with the exterior of said bridge plug body;

a plurality of calibrated rings formed by enlargements of the exterior surface of said wall calibrated to fit the well diameter in which the bridge plug is to be applied;

an interchangeable converter plug mounted in the end of said tubular body adjacent said enlarged portion thereof between said chamber and the tubular body;

a lower compression piece located below the elastic gasket and fastened to said tubular body by a fuse pin and having an external frusto conical surface thereon;

a frusto conical surface on the exterior of said enlarged diameter portion spaced below said lower compression piece; and the dentated fastening means comprises a one piece cylindrical jaw member mounted on said tubular body between said lower compression piece and said enlarged diameter portion, two oppositely directed diverging frusto conical surfaces on the interior surface of said jaw member at least partially operatively engaging respectively in superposition said frusto conical surfaces on said lower compression piece and enlarged diameter portion, substantially circumferential saw teeth on the exterior surface of said jaw member arranged so that the points on said teeth on opposite sides of a substantial middle position on the exterior surface of said jaw member are oppositely directed, and a plurality of circumferentially spaced axially directed slots in the exterior surface of said jaw member to produce weak fracture areas in said jaw member which fracture in response to predetermined relative movement toward each other of said lower compression piece and said enlarged diameter portion of said bridge plug.

2. A bridge plug as claimed in claim 1 wherein, said interchangeable converter plug is a bull plug threadedly engaged in said tubular body.

3. A bridge plug as claimed in claim 1 and further comprising:

an axial hole through said converter plug; and a steel tube inserted in said axial hole having a calibrated axial hole therein to control flow therethrough.

4. A bridge plug as claimed in claim 3 wherein said steel tube is adapted to be mounted in said converter plug so that it can be interchanged by remote means.

5. A bridge plug as claimed in claim 1 and further comprising:

an upward flow valve in said converter plug.

6. A bridge plug as claimed in claim 1 and further comprising:

a downward flow valve in said converter plug.

7. A bridge plug as claimed in claim 1 wherein, said converter plug is provided with an articulated joint.

8. A bridge plug as claimed in claim 1 wherein said slots in said jaw member are radially directed to reduce the thickness of said jaw member at said weak fracture areas.

9. A bridge plug as claimed in claim 8 wherein said plurality of slots in said jaw member comprises seven equally spaced slots which divide said jaw member into seven equally sized fracture separable segments.

10. A bridge plug as claimed in claim 9 wherein said jaw member further comprises:

a central cylindrically shaped interior surface area having a diameter substantially equal to the outer diameter of said tubular body to facilitate mounting said jaw member onto said tubular body; and said two oppositely directed diverging frusto conical surfaces on said jaw member diverge radially outwardly from said central cylindrically shaped surface.

11. A bridge plug as claimed in claim 1 wherein said plurality of slots in said jaw member comprises seven equally spaced slots which divide said jaw member into seven equally sized fracture separable segments.

12. A bridge plug as claimed in claim 1 wherein said jaw member further comprises:

a central cylindrically shaped interior surface area having a diameter substantially equal to the outer diameter of said tubular body to facilitate mounting said jaw member onto said tubular body; and said two oppositely directed diverging frusto conical surfaces on said jaw member diverge radially outwardly from said central cylindrically shaped surface.

13. A bridge plug as claimed in claim 1 wherein said saw teeth above said middle position on said jaw member are directed upwardly.

14. A bridge plug as claimed in claim 1 and further comprising:

an upper compression piece disposed above the elastic gasket having a conical surface portion directed downwardly toward said elastic gasket, and an internal substantially cylindrical surface in surrounding spaced relationship with respect to said tubular body to provide an annulus therebetween;

a cylindrical fastener ring disposed in said annulus;

an axially directed keyslot through said fastener ring to provide a gap between free ends of said ring;

a keyway in said tubular body aligned with said keyslot;

a key extending in said keyway and said keyslot;

a fuse pin extending at least partially through said upper compression piece and through said fastener ring and key to connect these parts together; and interior and exterior saw tooth threads on said fastener ring, said interior threads having half the pitch of said exterior threads.

15. A bridge plug as claimed in claim 14 wherein said lower compression piece comprises:

a cylindrical member having an internal surface having a cylindrical portion and a frusto conical portion extending radially outwardly from said cylindrical portion;

said fuse pin fastening said lower compression piece to said tubular body being greater in cross-section than said fuses pin in said upper compression piece.

16. A bridge plug as claimed in claim 1 wherein said support pieces each comprise:

a laminar body having a substantially cup-shaped form;

a perforated central flat part to receive said tubular body;

a frusto conical part extending outwardly from the outer edge portion of said flat part; and a cylindrical flange of relatively reduced height extending from the outer edge portion of said frusto conical part.

17. A bridge plug as claimed in claim 1 wherein said elastic gasket comprises:

a substantially cylindrical tubular body;

extensions on both ends of said tubular body of relatively reduced diameter;

substantially radially extending ribs on the outer ends of said extensions;

a trapezoidal channel in the inner surface of said elastic tubular body;

a trapezoidal cross-section metal ring housed in said channel and conforming substantially therewith;

a toric seal channel in the inner surface of said metal ring; and a toric seal in said toric seal channel.

18. A bridge plug as claimed in claim 1 and further comprising:

a frusto conical outer surface at the lower end of said enlarged diameter portion;

a plurality of slots through said frusto conical surface to form a dentated lower end on said bridge plug; and wherein said plurality of calibrated rings comprises, a cylindrical surface of relatively greater width adjacent the frusto conical surface on the enlarged diameter portion engaging said jaw member, and two annular surfaces of smaller width axially spaced therefrom adjacent said lower end of said bridge plug and axially spaced with respect to each other by an annular channel of reduced diameter.

19. A bridge plug as claimed in claim 1 wherein said converter plug comprises a hollow sleeve coupling having a reduced circumferentially extending groove in the inner surface thereof to produce a reduced thickness fracturable section, and external screw threads on the outer surface thereof for engaging with internal screw threads on said tubular lower end portion of the bridge plug and a hollow tubular tool.

* * * * *